US005482455A

United States Patent [19]

Salter

[11] Patent Number: 5,482,455

[45] Date of Patent: Jan. 9, 1996

[54] HAND-HELD ELECTRICALLY POWERED FLAME PRODUCER USING DISPOSABLE FLAMESTRIPS

[76] Inventor: Robert F. Salter, 15223 22nd Pl. W., Lynnwood, Wash. 98037

[21] Appl. No.: 321,113

[22] Filed: Oct. 11, 1994

[51] Int. Cl.[6] ..... F23D 1/00; F21V 33/00

[52] U.S. Cl. ..... 431/253; 431/128; 431/249; 362/109; 362/157; 362/202; 362/205; 362/253

[58] Field of Search ..... 431/249, 127, 431/128, 253; 102/202.5, 202; 149/92; 362/109, 157, 202, 205, 253

[56] References Cited

U.S. PATENT DOCUMENTS

| | | | |
|---|---|---|---|
| 1,466,779 | 9/1923 | Anakin | 362/109 |
| 2,346,325 | 4/1944 | Oliver | 340/815.4 |
| 3,056,701 | 10/1962 | Fritzen | 102/202 |
| 3,280,061 | 10/1966 | Ostrow | 524/272 |
| 4,586,435 | 5/1986 | Bock | 102/202.5 |
| 4,608,102 | 8/1986 | Krampen et al. | 149/92 |
| 4,816,971 | 3/1989 | Chin | 362/200 |
| 5,221,860 | 6/1993 | Shimoji | 431/258 |

*Primary Examiner*—Larry Jones
*Attorney, Agent, or Firm*—Robert W. Jenny

[57] ABSTRACT

The assembly which produces the flame is made up of a strip of conductive material, narrowed over an intermediate portion lengthwise, laminated onto a strip of combustible material such as cardboard, folded lengthwise over the strip such that the narrowed portion of the conductive strip is in a notch at one end of the combustible strip. The notched end of the combustible strip is saturated with a highly combustible material such as candle wax. Applying electrical power to the ends of the conductive strip causes the narrowed section to glow and ignite the highly combustible material and thereby the end of the combustible strip. This flame producing assembly is termed a flamestrip. The flamestrips are disposable. The flame producer includes a cassette which holds a plurality of flame strips and enables dispensing them one by one. The cassette may be adapted for attachment to a flashlight so that the power to produce the flame is drawn from the flashlight batteries. As a safety measure, two switches are used to complete the electrical circuit from the batteries through the flamestrip being dispensed. In an alternate embodiment the cassette incorporates a battery and is self sufficient; however, the battery portion of the cassette may be inserted into a specially adapted flashlight.

12 Claims, 2 Drawing Sheets

FIG. 1
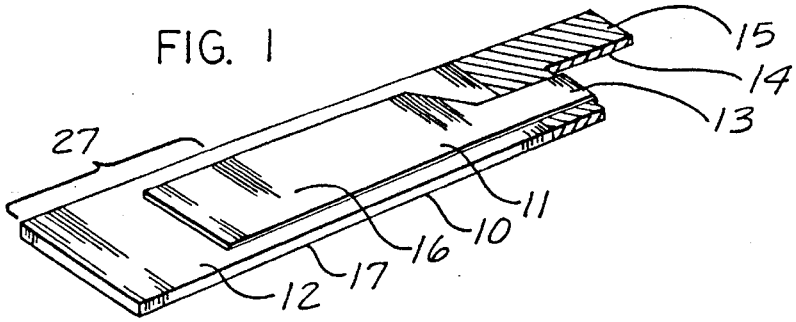
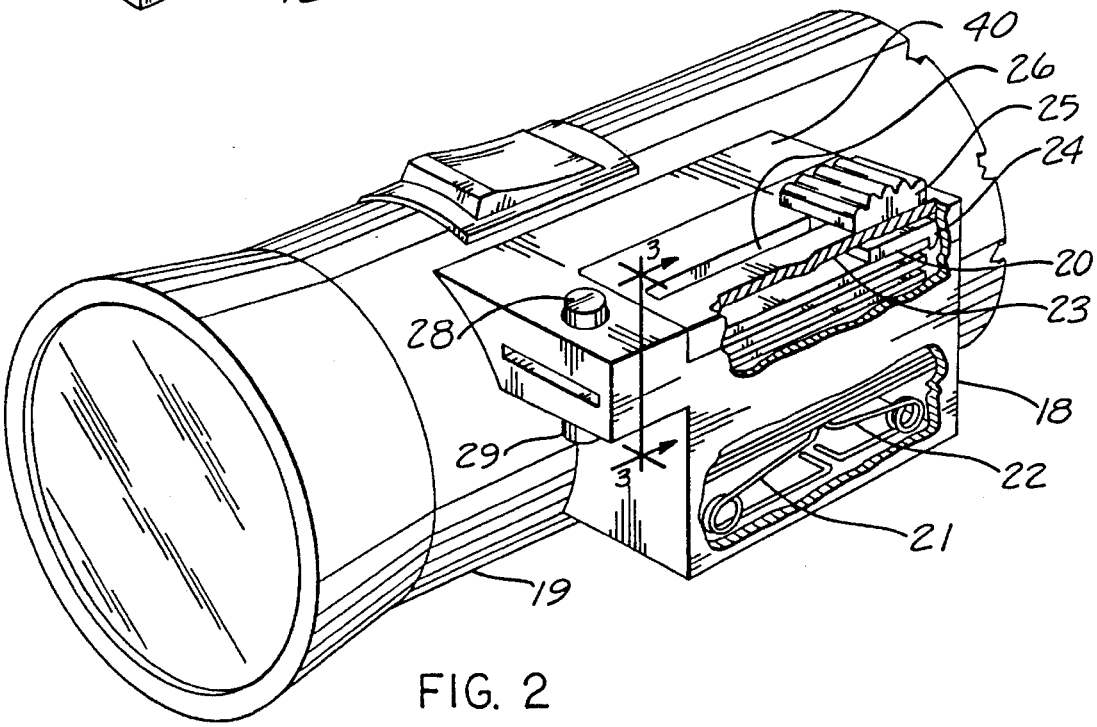
FIG. 2
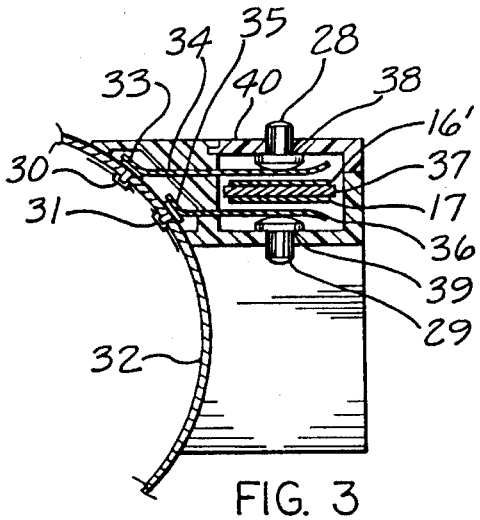
FIG. 3
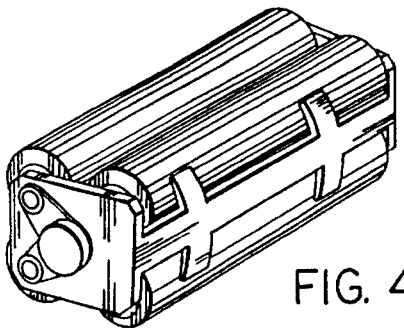
FIG. 4

HAND-HELD ELECTRICALLY POWERED FLAME PRODUCER USING DISPOSABLE FLAMESTRIPS

BACKGROUND OF THE INVENTION

1. Field

The subject invention is in the field of devices and apparatus which produce a flame suitable for lighting a fire, a gas stove, an alcohol burner and the like. More specifically it is in the field of electrically powered flame producers and, still more specifically, battery powered flame producers.

2. Prior art

While there is much prior art in the field of electrically powered flame producers, there is no prior art hand-held battery powered flame producer using disposable flamestrips known to the inventor of the subject invention, in spite of the clear advantages such a flame producer would provide to people already provided with batteries for other purposes such as lighting and radio power. The life threatening dangers of being stranded in the wilderness without the means of igniting a fire is a dire situation outdoorspeople such as hikers, hunters and campers diligently seek to avoid. For this reason outdoorspeople normally always carry matches and butane lighters. These are adequate fire starters as long as they work well and are on hand. But if matches get damp they will not strike and a butane lighter may run out of butane, and will not ignite. When this happens, the outdoorsperson needs a convenient, dependable, fast means of starting a fire. A hiker, hunter or camper who is lost or stranded in the woods in cold weather may quickly die from hypothermia if unable to start a fire for warmth and/or signaling.

The problem of making fire without matches has been partially solved in various ways over many years by commonly known methods such as flint and steel with sparks struck into dry tender or strong sunlight concentrated by a magnifying glass onto paper. To improve on these time consuming and uncertain techniques other means have been devised in more recent times. The following fire starting means have been found in a patent search related to the subject invention:

U.S. Pat. No. 1,466,779
Sep. 4, 1923
A. E. Anakin
Combined Cigar Lighter and Flash Light
Filed Mar. 15, 1922
U.S. Pat. No. 3,280,601
Oct. 25, 1966
S. Ostrow
Metal Foil Flashlight
Filed Dec. 13, 1960
U.S. Pat. No. 453,456
Jun. 2, 1891
Automatic Lighting Device
C. H. Wolf, Zwikau, Germany
Filed Aug. 20, 1890
U.S. Pat. No. 4,816,971
Mar.28, 1989
Kurt L. Chin, Taiwan
Flashlight with Built-in Lighter
Filed May 10, 1988

U.S. Pat. No. 2,346,325
Apr. 11, 1944
G. F. N. Oliver, London, England
Light Bouy
Filed Aug. 26, 1941
U.S. Pat. No. 4,189,305
Feb. 19, 1980
William J. Clayton, Fairport, N.Y.
Smokeless Fire Kindling Device
Filed Jul. 27, 1978
U.S. Pat. No. 3,056,701
Oct. 2, 1962
Thomas L. Fritzlen, Mooreland Farms, Va.
Combustion System Comprising Metal Foil and Solid Perchlorate
Filed Apr. 30, 1958
U.S. Pat. No. 5,221,820
Yutaka Shimoji, Clearwater, Fla.
Laser Cigarette Lighter
Filed Dec. 13, 1991

Whatever the precise merits, features and advantages of the above cited references, none of them achieves or fulfills the primary objective of the present invention which objective is to provide a plurality of electrically energizable flame producers contained in a cassette attachable to a conventional flashlight so that the flashlight serves for lighting as usual and for flame production, each flamestrip expending itself in use and being disposable. A second objective is provision of apparatus for storing, dispensing and using flamestrips independently of a flashlight or with a flashlight. Another objective is that the invention be safe in that inadvertent ignition of flamestrips is not possible.

SUMMARY OF THE INVENTION

The flame producing assembly of the subject invention, called a flamestrip, comprises (1) a strip of material which is combustible and at least part of which is saturated and/or coated with readily flammable material and (2) an electrically conductive component fastened to the strip and configured such that a portion of the conductive component is in contact with or close to the flammable material. The electrical resistance of that portion of the conductive elements is such that passing electric current through the conductive component causes the temperature of that portion to increase sufficiently to ignite the flammable material and subsequently the material of which the strip is made. Hard, thin cardboard is a suitable strip material. A preferred composition of the conductive component is thin aluminum foil laminated with thin paper. Candle wax is a suitable flammable material. The flamestrip can also be made without the layer of thin paper.

The use facilitating and safety augmenting apparatus comprises a cassette which holds a plurality of the flamestrips and electrical apparatus such that when one flamestrip is dispensed part way from the cassette it is positioned so that battery power can be applied to it but only when both of two self opening switches are held closed. No power is wasted by holding the switches closed after the flame is produced because a portion of the conductive component is destroyed in the process, interrupting the flow of electrical power. In a preferred embodiment the power is obtained from a battery powered flashlight which is modified to accommodate the flame producing apparatus, including the electrical conductors, switches and a cassette containing the flamestrips. In a modification of this embodiment spare batteries and a spare cassette are included in the assembly. Incorporation of the flame producer into a flashlight is expedient because it makes it unnecessary to deal with an extra item in order to have the reassurance of having a source of flame always available.

The invention is described in more detail below with reference to the attached drawings.

BRIEF DESCRIPTION OF THE DRAWING

FIG. 1 illustrates one embodiment of the flame producing assembly of the subject invention.

FIG. 2 illustrates the subject flame producer adapted to and attached to a battery powered flashlight.

FIG. 3 is a section taken at 3—3 in FIG. 2 showing the switching for operating the flame producer on the flashlight.

FIG. 4 illustrates a battery pack which can replace one of the batteries in the flashlight to provide a reserve pair of batteries for flame producing purposes.

DETAILED DESCRIPTION OF THE INVENTION

Figure 5:
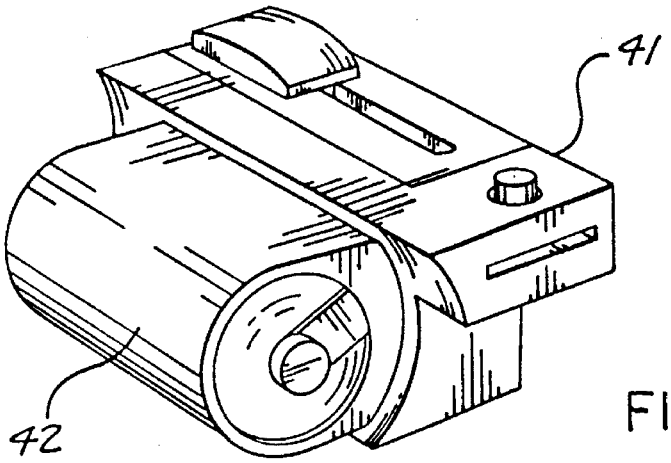
FIG. 5 illustrates an embodiment of the subject invention usable independently or installed on a flashlight modified to accept it.

The subject invention is a hand-held, electrically powered flame producer. FIG. 1. illustrates flame producer assembly 10, termed a flamestrip for purposes of this disclosure, comprising strip 11 made of electrically conductive material such as aluminum foil and a base 12 made of combustible material such as cardboard or the material from which book matches are made. Strip 11 has a narrow section 13 and is wrapped over the base with section 13 straddling the base in notch 14. The strip is held onto the base with adhesive. End portion 15 of the base is saturated and/or coated with readily combustible material such as candle wax, as indicated by the shading. End 16 and end 17 (not visible in this view) of the strip serve as electrical terminals. The thickness and other dimensions of the strip are such that applying one or more volts of battery power causes section 13 to glow with temperature rising above the ignition temperature of the combustible material, therefore the glow ignites the readily combustible material and end portion 15 of the base, producing the desired flame. The heated material then melts, shutting off the flow of electrical power. The foil strip may be replaced by a wire having a high resistance section provided by a reduction in cross sectional area or by a compositional difference.

FIG. 2 illustrates a cassette 18 used in the subject flame producer adapted for attachment to and use with battery powered flashlight 19. The cassette holds a plurality of flamestrips, flamestrip 20 being typical. Springs 21 and 22 force the flamestrips toward the top 23 of the cassette. The topmost flamestrip is engaged by lip 24 on slide 25 which slides in slot 26. Moving the slider along the slot moves most of the topmost flamestrip out of the cassette, leaving portion 27 (FIG. 1) of the flamestrip still in the cassette with ends 16 and 17 in position to be contacted by conductors (explained below) through which battery power is applied to the ends to ignite the flamestrip as described above. Switch buttons 28 and 29 must both be pressed in order to produce the flame. This feature helps to prevent accidental ignition. To produce a flame the switch buttons are pressed between thumb and forefinger and when the flame is produced the thumb and forefinger are in position to grasp the flamestrip and remove it for use and disposal. The slider is returned to its original position to engage the next topmost flamestrip, readying the producer for the next use. FIG. 3 is a section taken at 3—3 in FIG. 2. Flashlight 19 is modified, using techniques well known in the art, to provide positive and negative terminals 30 and 31 respectively in its casing 32. End 33 of flat spring 34 contacts terminal 30 and end 35 of flat spring 36 contacts terminal 31. The springs extend as shown across terminals 16' and 17' on flamestrip 37. Buttons 28 and 29 are held in place in holes 38 and 39 respectively by the flat springs. Pressing the buttons deflects the springs into contacts with the terminals on the flamestrip, causing it to ignite. When the pressure on the buttons is released the springs return to their at rest condition, leaving room for another flamestrip to be dispensed and put into position for ignition.

Cover 40 on the cassette is removable, with the slider, for installation of flamestrips. The cassette is attached to the flashlight casing by adhesives or fasteners, as dictated by production design considerations.

Cassettes can be provided with no provision for attachment to a flashlight but with terminals for connecting the cassette to any suitable power supply.

FIG. 4 illustrates a pack of 4 AA size batteries which fits in the space of a D size battery. The batteries are connected in two separate parallel circuits with one pair in use at a time and the other pair in reserve. When necessary, adjustments are made to put the reserve batteries into service. Battery selection switching apparatus may be incorporated in the flame producer for this purpose.

FIG. 5 illustrates another embodiment of the subject invention comprising a cassette 41 which is similar to cassette 18 but which is adapted to hold a battery or battery assembly such as shown in FIG. 4 so that cassette 41 is self sufficient and operable without being installed in a flashlight. However, cassette 41 is configured so that it can be assembled into a flashlight adapted to accept it, the adaptation consisting primarily of an opening in the cylinder of the flashlight into which battery casing portion 42 of cassette 41 will fit, replacing the battery or one of the batteries of the flashlight. The power of all the batteries is then available to both the cassette and the light of the flashlight.

Figure 6:
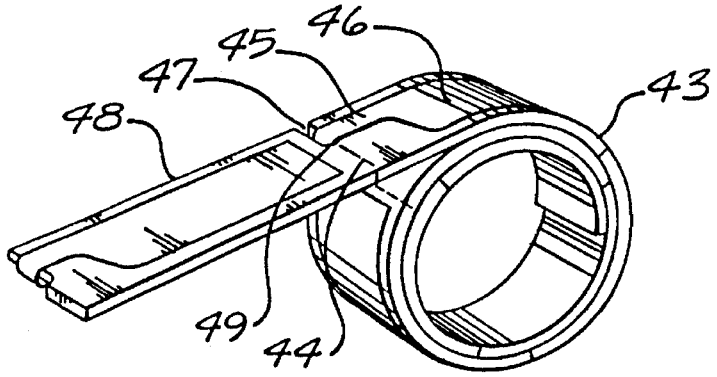
FIG. 6 illustrates flamestrips incorporated into a role for storage and dispensing.
Figure 7:
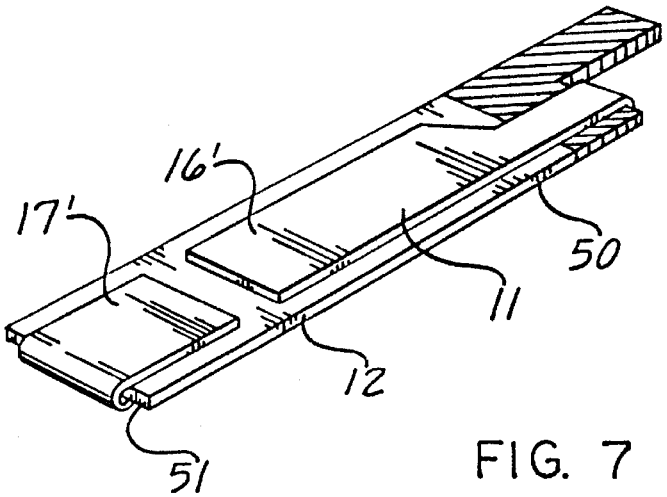
FIG. 7 illustrates an alternate embodiment of a flamestrip.

FIG. 6 shows a flamestrip configuration which allows the flamestrips to be rolled into a coil 43 and stored in and dispensed from a cassette shaped to hold the coil. The flamestrips are dispensed in the same way as with cassette 18; however, it would be necessary to break each flamestrip off from the roll at the perforations between flamestrips, perforation 44 being typical. Narrowed portion 45 of each conductive strip 46 fits in a notch 47 in the basic strip 48. The perforations extend from the bottoms of the matches, bottom 49 being typical. Portions of the basic strip which are under the narrowed portions of the conductive strips are saturated with highly flammable materials, as indicated by the hatching FIG. 7 illustrates an alternate embodiment of the flamestrip. Flamestrip 50 is similar to the flamestrip shown in FIG. 1. However, end 17' extends around end 51 of base 12' but not contacting end 16' of conductive strip 11'. This embodiment is useful in apparatus using a battery which has both terminals on one end, such as a conventional nine volt battery.

It is considered to be understandable from this description that the subject invention meets its objectives. It provides a flame producer operable with batteries such as those normally used in flashlights and small radios. Apparatus is provided which facilitates and augments the safety of use of the flame producer.

It is also considered to be understood that while certain embodiments of the invention are disclosed herein, other embodiments and modifications of those disclosed are possible within the scope of the subject invention which is limited only by the attached claims.

I claim:

1. A hand-held flame producer comprising at least one flamestrip further comprising:

a base strip of combustible material having a base strip portion saturated with highly combustible material, an electrically conductive strip having first and second ends and a high resistance portion of said length, said electrically conductive strip being laminated onto said base strip with said high resistance portion in close proximity to said base strip portion, whereby application of electrical power to said first and second ends causes said high resistance portion to glow, igniting said combustible material and said base strip portion.

2. The hand-held flame producer of claim 1 further comprising a cassette for holding a plurality of said flamestrips and further comprising means for dispensing one flamestrip at a time from said cassette.

3. The flame producer of claim 2 adapted for use on a flashlight powered by at least one battery, said flashlight having a case and first and second terminals on said case to provide power from said at least one battery, said cassette further comprising first means for conducting electrical power from said first terminal to said first end of said second strip, and second means for conducting electrical power from said second terminal to said second end of said second strip, said first and second means for conducting being normally not in contact with said first and second ends, said cassette further comprising first means for putting said first means for conducting into contact with said first end and second means for putting said second means for conducting into contact with said second end.

4. The flame producer of claim 3 further comprising a layer of thin paper laminated between said electrically conductive component and said base strip.

5. The hand-held flame producer of claim 2 further comprising a battery portion and a battery enclosed in said battery portion and means comprising two switches for applying power from said battery to said first and second ends.

6. The hand-held flame producer of claim 5 further comprising a flashlight having at least one battery and adapted for insertion of said battery portion of said cassette into said flashlight, said flame producer further comprising means for electrically interconnecting said battery in said cassette and said at least one battery in said flashlight.

7. The flame producer of claim 6 further comprising a layer of thin paper laminated between said electrically conductive component and said base strip.

8. The flame producer of claim 5 further comprising a layer of thin paper laminated between said electrically conductive component and said base strip.

9. The flame producer of claim 2 further comprising a layer of thin paper laminated between said electrically conductive component and said base strip.

10. The flame producer of claim 1 further comprising a layer of thin paper laminated between said electrically conductive component and said base strip.

11. A hand-held electrically powered flame producer comprising at least one flamestrip which further comprises:

an electrically conductive component having an intermediary section having high electrical resistance and first and second ends, a base strip made of combustible material having an end and a notch in said end, said end being saturated with readily combustible material, said electrically conductive component attached to said base strip with said intermediary section straddling said notch and said first and second ends of said electrically conductive component accessible for application of electrical power, whereby when electrical power is applied to said first and second ends of said conductive component said high resistance section glows with such heat as to ignite the readily combustible material with which the tip of the combustible base strip is saturated, producing a prompt, lingering flame usable for firestarting purposes and which, after being expended in this process, is disposable.

12. The flame producer of claim 6 further comprising a layer of thin paper laminated between said electrically conductive component and said base strip.

* * * * *